US009016253B2

(12) United States Patent
Kishimoto et al.

(10) Patent No.: US 9,016,253 B2
(45) Date of Patent: Apr. 28, 2015

(54) SPARK PLUG FOR INTERNAL COMBUSTION ENGINE

(75) Inventors: Kaori Kishimoto, Nagoya (JP); Katsutoshi Nakayama, Nagoya (JP); Hiroyuki Kameda, Aichi-gun (JP); Tomoaki Aoki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 1509 days.

(21) Appl. No.: 12/668,858

(22) PCT Filed: May 29, 2008

(86) PCT No.: PCT/JP2008/059926

§ 371 (c)(1), (2), (4) Date: Jan. 12, 2010

(87) PCT Pub. No.: WO2009/011173

PCT Pub. Date: Jan. 22, 2009

(65) Prior Publication Data

US 2010/0206256 A1 Aug. 19, 2010

(30) Foreign Application Priority Data

Jul. 17, 2007 (JP) ..... 2007-185345

(51) Int. Cl.
*H01T 13/34* (2006.01)

(52) U.S. Cl.
CPC ..... *H01T 13/34* (2013.01)

(58) Field of Classification Search
CPC ..... H01T 13/20; H01T 13/24; H01T 13/30; H01T 13/34; H01T 13/36; H01T 13/39; H01T 13/16; H01T 13/38
USPC ..... 313/118, 119, 143, 122, 123, 124, 125, 313/132, 140, 141, 142
See application file for complete search history.

(56) References Cited

U.S. PATENT DOCUMENTS 1,995,483 A 3/1935 Rabezzana
2,296,045 A * 9/1942 McDougal ..... 313/11.5
(Continued)

FOREIGN PATENT DOCUMENTS

EP 0287080 A1 10/1988
EP 1837964 A2 * 9/2007
(Continued)

OTHER PUBLICATIONS

"Road vehicles—M12 x 1,25 spark-plugs with flat seating and 14 mm bi-hexagon and their cylinder head housing", International Standard, ISO 22977, Jul. 2005.
(Continued)

*Primary Examiner* — Hai Huynh
*Assistant Examiner* — Raza Najmuddin
(74) *Attorney, Agent, or Firm* — Sughrue Mion, PLLC

(57) ABSTRACT

There is provided a spark plug for an internal combustion engine, including: a center electrode extending in the direction of an axis of the spark plug and having a core of higher thermal expansion coefficient than that of a front end thereof, the center electrode including a flanged portion radially outwardly protruding on a rear side thereof and a cylindrical portion located closer to a front end of the spark plug than the flanged portion and being smaller in diameter than the flanged portion; an insulator having an axial hole in the direction of the axis to retain the flanged portion in the axial hole with the cylindrical portion held in a loose-fit state in the axial hole; and a metal shell accommodating the insulator, wherein the spark plug satisfies the following condition: Cb<Cf where Cb is a difference between an inner diameter of the axial hole and an outer diameter of the cylindrical portion at an arbitrary axial position B in the direction of the axis; and Cf is a difference between the inner diameter of the axial hole and the outer diameter of the cylindrical portion at an axial position F closer to the front end of the spark plug than the axial position B in the direction of the axis.

15 Claims, 11 Drawing Sheets

(56) References Cited

U.S. PATENT DOCUMENTS

| | | | | | |
|---|---|---|---|---|---|
| 3,061,756 | A * | 10/1962 | Henderson | 313/145 |
| 4,400,643 | A * | 8/1983 | Nishio et al. | 313/11.5 |
| 4,539,503 | A * | 9/1985 | Esper et al. | 313/11.5 |
| 4,659,960 | A * | 4/1987 | Toya et al. | 313/141 |
| 4,808,135 | A * | 2/1989 | Sakura et al. | 445/7 |
| 4,845,400 | A | 7/1989 | Takamura et al. | |
| 5,124,612 | A * | 6/1992 | Takamura et al. | 313/141 |
| 5,159,232 | A | 10/1992 | Sato et al. | |
| 5,239,225 | A * | 8/1993 | Moriya et al. | 313/141 |
| 5,569,971 | A | 10/1996 | Clifford et al. | |
| 5,926,556 | A * | 7/1999 | Douglas et al. | 382/142 |
| 5,929,556 | A * | 7/1999 | Matsubara et al. | 313/141 |
| 6,265,816 | B1 * | 7/2001 | Ito et al. | 313/141 |
| 6,509,676 | B1 * | 1/2003 | Durling | 313/137 |
| 6,583,538 | B1 | 6/2003 | Adolf et al. | |
| 6,611,084 | B2 * | 8/2003 | Teramura et al. | 313/141 |
| 6,956,319 | B2 * | 10/2005 | Hanashi et al. | 313/141 |
| 7,262,547 | B2 | 8/2007 | Klett et al. | |
| 7,298,070 | B2 * | 11/2007 | Kanao | 313/141 |
| 7,944,134 | B2 * | 5/2011 | Kyuno et al. | 313/141 |
| 8,115,371 | B2 * | 2/2012 | Kyuno et al. | 313/141 |
| 8,215,277 | B2 * | 7/2012 | Suzuki et al. | 123/169 E |
| 8,242,673 | B2 * | 8/2012 | Nunome | 313/141 |
| 2002/0036450 | A1 * | 3/2002 | Nishikawa | 313/118 |
| 2002/0036451 | A1 * | 3/2002 | Nishikawa et al. | 313/118 |
| 2002/0041138 | A1 * | 4/2002 | Nishikawa | 313/143 |
| 2002/0070646 | A1 * | 6/2002 | Chiu | 313/141 |
| 2003/0001474 | A1 * | 1/2003 | Teramura et al. | 313/141 |
| 2003/0020388 | A1 * | 1/2003 | Pollner | 313/145 |
| 2003/0122462 | A1 * | 7/2003 | Nishikawa et al. | 313/143 |
| 2005/0057135 | A1 | 3/2005 | Yoshimoto et al. | |
| 2005/0168120 | A1 | 8/2005 | Kanao et al. | |
| 2006/0028108 | A1 * | 2/2006 | Okabe et al. | 313/143 |
| 2006/0113883 | A1 * | 6/2006 | Kanao | 313/141 |
| 2008/0174223 | A1 * | 7/2008 | Suzuki | 313/143 |
| 2011/0095672 | A1 * | 4/2011 | Ban et al. | 313/142 |
| 2012/0142244 | A1 * | 6/2012 | Ochiai | 445/7 |
| 2012/0153800 | A1 * | 6/2012 | Nunome | 313/141 |

FOREIGN PATENT DOCUMENTS

| | | | |
|---|---|---|---|
| EP | 2180565 | A1 * | 4/2010 |
| JP | 64-027176 | A | 1/1989 |
| JP | 2001-068249 | A | 3/2001 |
| JP | 2001-155838 | A | 6/2001 |
| JP | 2001155838 | A | 6/2001 |
| JP | 2005-079097 | A | 3/2005 |
| JP | 2005-108821 | A | 4/2005 |
| JP | 2005-243610 | A | 9/2005 |
| JP | 2006-156110 | A | 6/2006 |
| JP | 2006-236906 | A | 9/2006 |
| JP | 2007287667 | A * | 11/2007 |

OTHER PUBLICATIONS

European Search Report dated Jul. 11, 2013 issued in corresponding European Patent Application No. 08776988.1.

* cited by examiner

SPARK PLUG FOR INTERNAL COMBUSTION ENGINE

TECHNICAL FIELD

The present invention relates to a spark plug for an internal combustion engine.

BACKGROUND ART

A spark plug is mounted to an internal combustion engine for ignition of an air-fuel mixture in a combustion chamber. The spark plug includes an insulator formed with an axial hole, a center electrode inserted in the axial hole, a metal shell disposed on an outer periphery of the insulator and a ground electrode fixed to a front end face of the metal shell so as to define a spark gap between the center electrode and the ground electrode. In general, the metal shell and the insulator are assembled together by engaging a stepped portion of an inner peripheral surface of the metal shell with a stepped portion of an outer peripheral surface of the insulator via a metal plate packing. It has recently been proposed that the center electrode has an inner part made of copper or copper alloy, which shows a relatively high thermal conductivity, for enhancement of thermal radiation. (See Patent Document 1.) Patent Document 1: Japanese Laid-Open Patent Publication No. 2006-156110

There is a possibility that a carbon substance occurs due to incomplete combustion of the air-fuel mixture in the combustion chamber and gets deposited on the insulator surface. When such carbon deposits develop on and cover the insulator surface (i.e. the insulator is subjected to fouling), the spark plug may cause a flow (leak) of electric current from the center electrode to the metal shell through the carbon deposits without generating a spark discharge properly in the spark gap. As a measure against this problem, it has been proposed that the insulator has a longer portion (leg portion) exposed to the combustion chamber so as to, even if the same amount of carbon deposits occurs, reduce the likelihood that the carbon deposits will cover the insulator surface and then to improve the fouling resistance of the insulator.

However, the surface area of the leg portion increases with length so that the leg portion receives a greater amount of combustion gas heat during the combustion. The distance from the front end of the insulator (the leg portion) to the plate packing also increases with the length of the leg portion, thereby causing a deterioration in thermal radiation at the front end of the insulator and, by extension, a deterioration in thermal radiation in the leg portion of the insulator. As a result, the spark plug may not allow smooth heat transfer from the center electrode to the insulator and thus may not be able to maintain sufficient thermal radiation characteristics even when the inner part of the center electrode is made of relatively high thermal conductive material such as copper or copper alloy. In addition, the spark plug may cause expansion of the copper or copper alloy material due to the incapability of smooth heat transfer from the center electrode to the insulator since the copper and copper alloy material has a relatively high thermal expansion coefficient. This leads to expansion of the center electrode and raises a fear of a breakage in the insulator by the center electrode.

Disclosure of the Invention

In view of the foregoing, the present invention has been made to provide a spark plug for an internal combustion engine that is capable of enhancing thermal radiation of a center electrode, preventing the occurrence of a breakage in an insulator as well as achieving improvement in fouling resistance.

According to an aspect of the present invention, there is provided a spark plug for an internal combustion engine, comprising: a center electrode extending in the direction of an axis of the spark plug and having a core of higher thermal expansion coefficient than that of a front end thereof, the center electrode including a flanged portion radially outwardly protruding on a rear side thereof and a cylindrical portion located closer to a front end of the spark plug than the flanged portion and being smaller in diameter than the flanged portion; an insulator having an axial hole formed in the direction of the axis to retain the flanged portion in the axial hole with the cylindrical portion held in a loose-fit state in the axial hole; and a metal shell accommodating the insulator, wherein the spark plug satisfies the following condition: $Cb<Cf$ where Cb is a diameter difference between an inner diameter of the axial hole and an outer diameter of the cylindrical portion at an arbitrary axial position B in the direction of the axis; and Cf is a diameter difference between the inner diameter of the axial hole and the outer diameter of the cylindrical portion at an axial position F located closer to the front end of the spark plug than the axial position B in the direction of the axis.

BEST MODE FOR CARRYING OUT THE INVENTION

Figure 1:
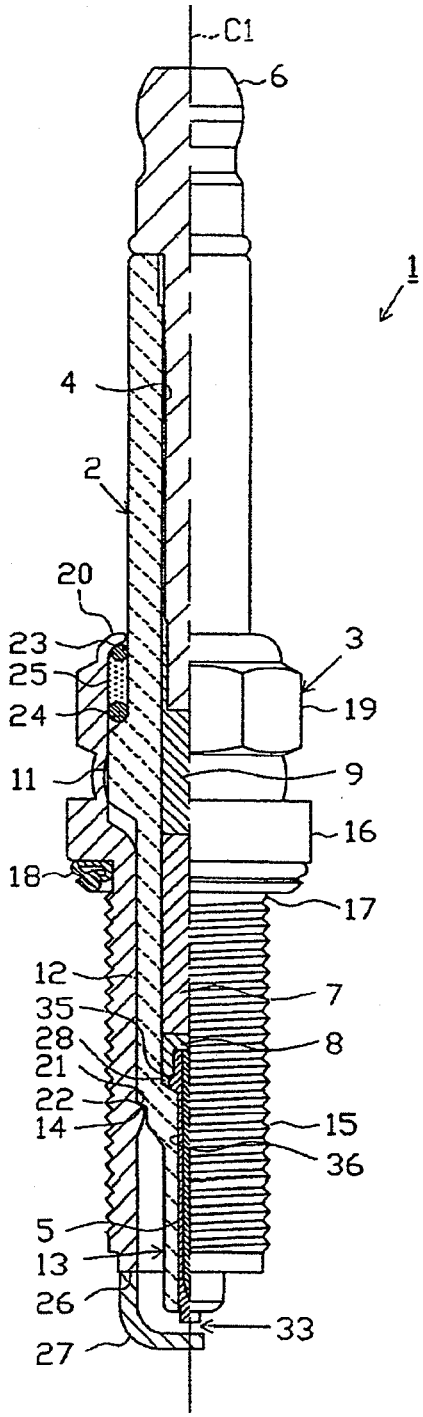
FIG. 1 is a partially cutaway view of a spark plug according to one embodiment of the spark plug.

A spark plug 1 for an internal combustion engine according to one embodiment of the present invention will be described in detail below with reference to the drawings. It is herein noted that: the terms "front" and "rear" refers to top and bottom sides of the drawing, respectively, when the direction of an axis C1 of the spark plug 1 is aligned with the top-to-bottom direction of the drawing; and the after-mentioned diameter differences Cb and Cf are indicated in a relatively exaggerated manner in the drawings for purposes of illustration.

As shown in FIG. 1, the spark plug 1 includes a ceramic insulator 2, a metal shell 3, a center electrode 5, a terminal electrode 6, a ground electrode 27 and a resistor 7.

The ceramic insulator 2 is made of sintered alumina or the like and cylindrical shaped with an axial hole 4 extending in the direction of the axis C1. A tapered stepped portion 28 is formed in a front side of the axial hole 4. Further, a portion of the axial hole 4 on a front side of the stepped portion 28 is formed with a constant inner diameter ϕB. The ceramic insulator 2 includes a flanged portion 11 radially outwardly protruding at a substantially center position in the direction of the axis C1, a middle body portion 12 located closer to the front end of the spark plug 1 than the flanged portion 11 and having a smaller diameter than that of the flanged portion 11 and a leg portion 13 located closer to the front end of the spark plug 1 than the middle body portion 12 and exposed to a combustion chamber of the internal combustion engine. A front part of the ceramic insulator 2, including the flanged portion 11, the middle body portion 12 and the leg portion 13, is accommodated in the cylindrical metal shell 3. The ceramic insulator 2 further includes a shoulder portion 14 formed at a connection between the leg portion 13 and the middle body portion 12. In the present embodiment, the leg portion 13 is made longer by a given length (for example, 1 mm to 2 mm) in the axis direction than that of a conventional spark plug of the same thermal value (i.e. of the same thermal radiation characteristics).

The center electrode 5 includes a flanged portion 35 radially outwardly protruding on a rear side thereof and a cylindrical portion 36 located closer to the front end of the spark plug 1 than the flanged portion 35 and having a smaller diameter than that of the flanged portion 35. The center electrode 5 is inserted and fixed in the front side of the axial hole 4, with a front end of the center electrode 5 protruding from a front end of the ceramic insulator 2, by engagement of the flanged portion 35 on the stepped portion 28.

The terminal electrode 6 is inserted and fixed in a rear side of the axial hole 4 with a rear end of the terminal electrode 6 protruding from a rear end of the ceramic insulator 2.

The resistor 7 is disposed between the center electrode 5 and the terminal electrode 6 within the axial hole 4 and is electrically connected at opposite ends thereof to the center electrode 5 and the terminal electrode 6 via conductive glass seal layers 8 and 9, respectively.

The metal shell 3 is made of metal material such as low carbon steel in a cylindrical shape. The metal shell 3 has an outer peripheral surface formed with a thread portion (external thread portion) 15 for mounting the spark plug 1 on a cylinder head of the engine. The metal shell 3 also has a plug seat portion 16 formed on the outer peripheral surface thereof at a position closer to the rear end of the spark plug 1 than the thread portion 15. A ring-shaped gasket 18 is fitted around a thread neck 17 at a rear end of the thread portion 15. Further, the metal shell 3 includes a tool engagement portion 19 of hexagonal cross section formed at a rear side thereof to engage with a tool such as a wrench for fixing the metal shell 3 in the engine cylinder block and a crimped portion 20 formed at a rear end of the metal shell 3 to retain therein the ceramic insulator 2. The metal shell 3 also has an inner peripheral surface formed with a stepped portion 21 to retain thereon the ceramic insulator 2. The ceramic insulator 2 is fixed in the metal shell 3 by inserting the ceramic insulator 2 from the rear to the front into the metal shell 3 and swaging the open rear end of the metal shell 3 radially inwardly to thereby form the swaged portion 22 with the shoulder portion 14 of the ceramic insulator 2 retained on the stepped portion 21 of the metal shell 3. An annular plate packing 22 is interposed between the shoulder portion 14 of the ceramic insulator 2 and the stepped portion 21 of the metal shell 3. In this configuration, the spark plug 1 maintains a seal against the combustion chamber so as to prevent air-fuel mixture leakage from between the inner peripheral surface of the metal shell 3 and the leg portion 13 of the ceramic insulator 2 exposed to the combustion chamber.

For more complete sealing by swaging, annular ring members 23 and 24 are disposed between the metal shell 3 and the ceramic insulator 2 in the rear end portion of the metal shell 3. Further, a talc powder 25 is filled in between these ring members 23 and 24. In other words, the metal shell 3 retains therein the ceramic insulator 2 via the plate packing 22, the ring members 23 and 24 and the talc power 25.

The ground electrode 27 is substantially L-shaped and is joined to a front end face 26 of the metal shell 3. The ground electrode 27 has a body joined at a rear end thereof by welding to the front end face 26 of the metal shell 3 and bent to direct a front end thereof in such a manner that a side surface of the front end of the ground electrode body faces a front end face of the center electrode 5. There is a spark gap 33 defined between the front end face of the center electrode 5 and the corresponding portion of the body of the ground electrode 27. Noble metal tips may be provided as needed on the front end face of the center electrode 5 and the corresponding portion of the ground electrode 27, respectively.

Figure 2:
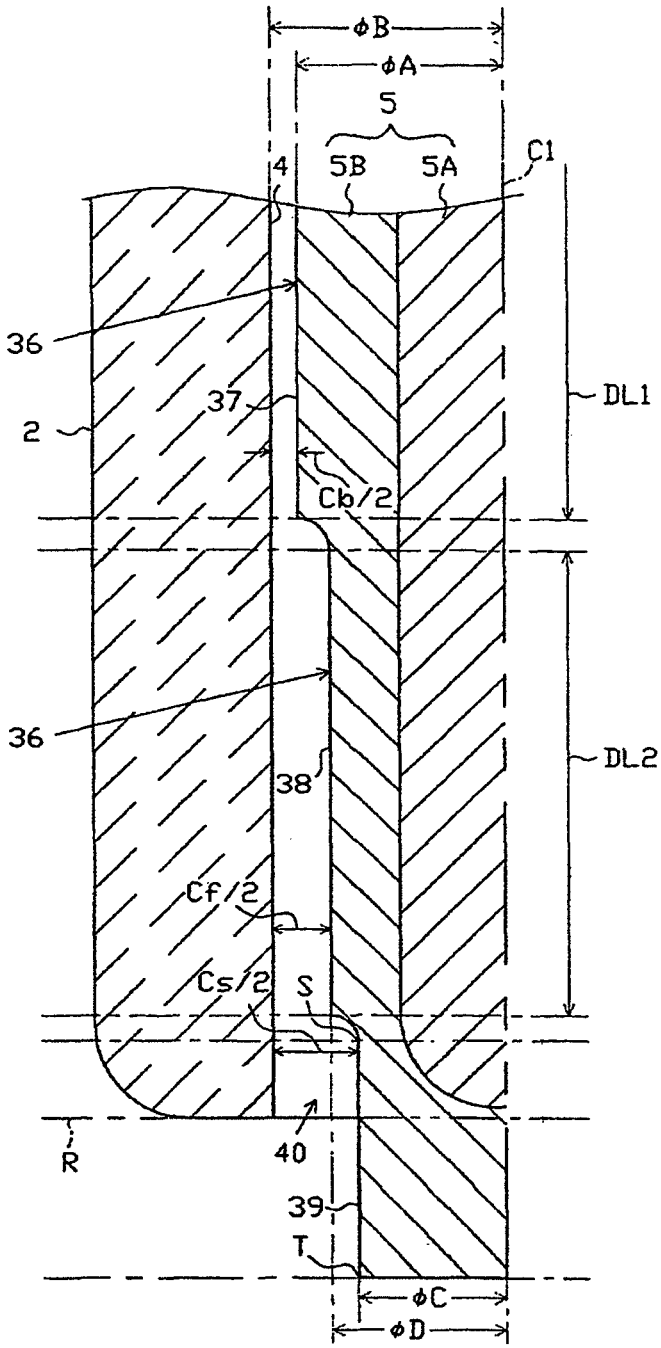
FIG. 2 is an enlarged section view of a front end portion of the spark plug according to the one embodiment of the present invention.

In the present embodiment, the center electrode 5 has an outer layer (covering layer) 5B made of nickel (Ni) alloy and an inner layer (core) 5A made of metal material having a higher thermal conductivity and thermal expansion coefficient that those of the outer layer 5B as shown in FIG. 2. As the metal material of higher thermal expansion coefficient, there can be used a relatively high thermal conductive metal material such as copper or copper alloy.

Further, the cylindrical portion 36 of the center electrode 5 is held in a loose-fit state in the axial hole 4. The loose-fit state of the cylindrical portion 36 means that there is a clearance between an outer peripheral surface of the cylindrical portion 36 and an inner peripheral surface of the axial hole 4, but does not specifically mean that the outer peripheral surface of the cylindrical portion 36 has no contact at all with the inner peripheral surface of the axial hole 4. It suffices that there is some clearance left between a part of the outer peripheral surface of the cylindrical portion 36 and the inner peripheral surface of the axial hole 4. As long as the center electrode 5 is retained in the axial hole 4 of the ceramic insulator 2 by inserting the cylindrical portion 36 into the axial hole 4 and engaging the flanged portion 35 on the stepped portion 28, the outer peripheral surface of the cylindrical portion 36 may come into contact with the inner peripheral surface of the axial hole 4 due to manufacturing variations.

Furthermore, the spark plug 1 is configured to satisfy the following condition: $Cb<Cf$ where Cb is a diameter difference between the inner diameter of the axial hole 4 and the outer diameter of the cylindrical portion 36 at an arbitrary axial position B; and Cf is a diameter difference between the inner diameter of the axial hole 4 and the outer diameter of the cylindrical portion 36 at an axial position F located closer to the front end of the spark plug 1 than the axial position B.

As the inner layer (core) 5A of the center electrode 5 is made of metal material of relatively high thermal expansion coefficient, the center electrode 5 enables enhanced thermal radiation as in the case of the conventional spark plug. By such enhanced thermal radiation of the center electrode 5, the spark plug 1 can maintain sufficient thermal radiation characteristics even when the portion (leg portion 13) of the ceramic insulator 2 exposed to the combustion chamber is made relatively long in length. It is accordingly possible to increase the length of the leg portion 13 and thereby improve the fouling resistance of the ceramic insulator 2.

On the other hand, there is a fear of a breakage in the ceramic insulator 2 by expansion of the center electrode 5 when the inner layer (core) 5A of the center electrode 5 is made of metal material of relatively high thermal expansion coefficient. In the present embodiment, the cylindrical portion 36 of the center electrode 5 is held in the loose-fit state in the axial hole 4 of the ceramic insulator 2 to satisfy the condition: Cb<Cf, i.e., to set the clearance between the ceramic insulator 2 and the cylindrical portion 36 at the axial position F larger than that at the axial position B. Although the thermal expansion of the center electrode 5 is more pronounced at the axial position F that is closer to the front end of the spark plug 1 than the axial position B, the increase in volume of the center electrode 5 due to such a thermal expansion can be absorbed by the clearance between the ceramic insulator 2 and the cylindrical portion 36 at the axial position F. It is thus possible to prevent the breakage in the ceramic insulator 2 by the center electrode 5.

For fouling resistance improvement, it is conceivable to decrease the diameter of the front end portion of the center electrode 5 and form an annular gap (called a "thermo gap") between the inner peripheral surface of the axial hole 4 and the outer peripheral surface of the front end portion of the center electrode 5. In this case, however, the diameter difference between the inner diameter of the axial hole 4 and the outer diameter of the center electrode 5 needs to be set to a relatively large degree (for example, 0.1 mm or larger). In order for the clearance between the axial hole 4 and the cylindrical portion 36 at the axial length F to perform the function of absorbing the increase in volume of the center electrode 5 rather than to function as the thermo gap, it is preferable that the value of subtraction of the diameter difference Cb from the diameter difference Cf is set larger than 0 mm and smaller than or equal to 0.06 mm. When the value of subtraction of the diameter difference Cb from the diameter difference Cf is set to satisfy the condition: 0 mm of <Cf–Cb≤0.06 mm, the spark plug 1 can obtain a sufficient effect of maintaining good thermal radiation of the center electrode 5 while preventing the breakage in the ceramic insulator 2.

It is also preferable that the difference Cb between the inner diameter of the axial hole 4 and the outer diameter of the cylindrical portion 36 at the axial position B is set to such a relatively small degree that allows smooth thermal radiation from the center electrode 5 to the ceramic insulator 2. For example, the diameter difference Cb is preferably set to 0.01 mm to 0.09 mm. Although it is desirable that the diameter difference Cb is as small as possible in terms of the thermal radiation characteristics, the diameter difference Cb may be set to 0.02 mm to 0.07 mm in consideration of the productivity and the possibility of a breakage in the ceramic insulator 2 due to a production tolerance.

It is further preferable that each of the axial positions B and F is located at least 3 mm rear from the front end face of the ceramic insulator 2 in the direction of the axis C1. In particular, the axial position F is preferably located in the range of 3 mm to 13 mm (e.g. at 10 mm) from the front end face of the ceramic insulator 2 in the direction of the axis C1. (In this case, the axial position B is located between the rear end of the cylindrical portion 36 and the axial position E.) The thermo gap is generally formed at a position closer to the front end of the spark plug 1 than a position 3 mm rear from the front end face of the ceramic insulator 2 in the direction of the axis C1. The axial regions of the diameter differences Cb and Cf can be thus clearly distinguished from the axial region of the thermo gap by setting the axial positions B and F to be at least 3 mm rear from the front end face of the ceramic insulator 2 in the direction of the axis C1. If the diameter difference Cf exceeds 0.06 mm at a position closer to the rear end of the spark plug 1 than the position 3 mm rear from the front end face of the insulator, there arises an increasing possibility that the thermal radiation of the center electrode 5 cannot be enhanced sufficiently.

More specifically, the cylindrical portion 36 of the center electrode 5 has a large-diameter section 37, a small-diameter section 39 and a middle-diameter section 38 having an outer diameter smaller than that of the large-diameter section 37 and larger than that of the small- diameter section 39 as shown in FIG. 2 in the present embodiment. Herein, the radius differences (i.e. clearance sizes) "Cb/2", "Cf/2" and "Cs/2" are indicated in the drawing in place of the diameter differences. For example, the outer diameter ϕA of the large-diameter section 37, the outer diameter ϕD of the middle-diameter section 38 and the outer diameter ϕC of the small-diameter section 39 are set to 2.59 mm, 2.57 mm and 2.5 mm, respectively. Further, the difference (0.02 mm) between the outer diameter ϕA of the large-diameter section 37 and the outer diameter ϕD of the middle-diameter section 38 is set smaller than the difference (0.07 mm) between the outer diameter ϕD of the middle-diameter section 38 and the outer diameter ϕC of the small-diameter section 39.

The small-diameter section 39 extends over an axial position R of the front end face of the ceramic insulator 2 and, more concretely, is formed between a position S 3 mm or less (1 mm in the present embodiment) rear from the front end face of the ceramic insulator 2 in the direction of the axis C1 and a front end position T of the cylindrical portion 36. By the formation of the small-diameter section 39 smaller in diameter than the middle- and large-diameter sections 38 and 37 and the flanged portion 35 closer to the rear end of the spark plug 1 than the small-diameter section 39, there is an annular gap 40 defined between the outer peripheral surface of the rear end of the small-diameter section 29 and the inner peripheral surface of the axial hole 4. Even when carbon fouling occurs in the annular gap 40 within the axial hole 4, the annular gap 40 allows a spark discharge to be generated therein and burn off the carbon fouling efficiently. That is, the annular gap 40 is expected to perform a so-called thermo gap function. This contributes to further improvement in fouling resistance.

The middle-diameter section 38 is made longer in the direction of the axis C1 than the small-diameter section 39 and is formed between a position directly rear of the rear end of the small-diameter section 39 and a position a given distance (e.g. 7 mm) rear from the position directly rear of the small-diameter section 39 in the direction of the axis C1.

The large-diameter section 37 is made longer in the direction of the axis C1 than the middle-diameter section 38. In the center electrode 5, the inner layer 5A extends from the flanged portion 35 through to the small-diameter section 39.

As the portion of the axial hole 4 on the front side of the stepped portion 28 is formed with the constant inner diameter ϕB as mentioned above, the area of the axial hole 4 corresponding in position to the cylindrical portion 36 in the direction of the axis C1 includes a plurality of regions (constant diameter difference regions) in each of which the diameter difference between the inner diameter ϕB of the axial hole 4 and the outer diameter ϕC of the cylindrical portion 36 is constant. The diameter difference between the inner diameter ϕB of the axial hole 4 and the outer diameter ϕC of the cylindrical portion 36 is kept substantially constant and may not be exactly constant, allowing for manufacturing variations and tolerances of ±0.01 mm or less. In the present embodiment, one of the constant diameter difference regions corresponding to the large-diameter section 37 is referred to as "a first constant diameter difference region DL1" and is the longest in axial distance; and one of the constant diameter difference regions corresponding to the middle-diameter section 38 is referred to as "a second constant diameter difference region DL2" and is the second longest in axial distance. The axial positions B is located in the first constant diameter difference region DL1, whereas the axial position F is located in the second constant diameter difference region DL2 that is closer to the front end of the spark plug 1 than the first constant diameter difference region DL1. The diameter difference Cb between the inner diameter ϕB of the axial hole 4 and the outer diameter ϕA of the cylindrical portion 36 (large-diameter section 37) in the first constant diameter difference region DL1 is the smallest in the cylindrical portion 36. The diameter difference Cf between the inner diameter ϕB of the axial hole 4 and the outer diameter ϕD of the cylindrical portion 36 in the second constant diameter difference region DL2 is set larger than the diameter difference Cb (Cb<Cf). Further, the diameter difference Cf is set smaller than the diameter difference Cs between the inner diameter ϕB of the axial hole 4 and the outer diameter ϕC of the small-diameter section 39 (Cf<Cs).

As explained above, the spark plug 1 of the present embodiment can maintain such merits as improvements in thermal radiation characteristics and fouling resistance and dissolve a demerit such as breakage in the ceramic insulator 2 by the center electrode 5.

A manufacturing method of the above spark plug 1 will be next explained below.

The metal shell 3 is first produced. Namely, a semifinished metal shell part is obtained by cold forging a through hole in a cylindrical metal material (e.g. iron-based material or stainless steel material) and cutting the cylindrical metal material into a predetermined shape. The ground electrode 27 of Ni alloy (e.g. Inconel alloy) is joined by resistance welding to a front end face of the semifinished metal shell part. As there arise so-called shear drops during the welding, these welding shear drops are removed from the joint between the semifinished metal shell part and the ground electrode 27. The thread portion 15 is formed by component rolling at a given position on the semifinished metal shell part, thereby providing the metal shell 3 with the ground electrode 27 welded thereto. The metal shell 3 with the ground electrode 27 is given zinc plating or nickel plating. For corrosion resistance improvement, the metal shell 3 with the ground electrode 27 may be further treated by chromating.

The ceramic insulator 2 is produced by molding separately from the metal shell 3. For example, a cylindrical molded part is formed by preparing a granulated molding material using an alumina-based raw material powder with a binder and molding the material by a rubber press. The molded part is shaped by cutting, fired in a furnace and subjected to various grinding processes, thereby completing the ceramic insulator 2.

The center electrode 5 is also produced separately from the metal shell 3 and the ceramic insulator 2. Namely, a semifinished center electrode part is prepared by forging the nickel alloy and providing the inner layer of copper or copper alloy in the center of the nickel alloy for enhancement of thermal radiation. The flanged portion 35 is formed on one end side (at which the copper alloy etc. is exposed) of the semifinished center electrode part. On the other hand, the small-diameter section 39 and the middle-diameter section 38 are formed sequentially from the front by swaging on the other end side (i.e. the cylindrical end side covered by the Ni alloy layer) of the semifinished center electrode part. By this, the center electrode 5 with the middle- and small-diameter sections 38 and 39 is obtained. The middle- and small-diameter sections 38 and 39 may alternatively be formed by cutting rather than by swaging.

The ceramic insulator 2, the center electrode 5, the terminal electrode 6 and the resistor 7 are assembled together with the glass seal layers 8 and 9. In general, a material of the glass seal layers 8 and 9 is prepared by mixing borosilicate glass and metal powder. The glass seal layers 8 and 9 are formed by filling the prepared glass seal material into opposite sides of the axial hole 4 of the ceramic insulator 4 to sandwich therebetween the resistor 7, and then, baking the material in a furnace while holding the terminal electrode 6 under pressure from the rear. At this time, a glaze layer may be applied to the surface of the rear cylindrical portion of the ceramic insulator 2 concurrently. The glaze layer may alternatively be applied in advance to the rear cylindrical portion of the ceramic insulator 2.

The subassembly of the metal shell 3 and the ground electrode 27 and the subassembly of the ceramic insulator 2 and the center and terminal electrodes 5 and 6 are fixed together by crimping the relatively-thin rear end of the metal shell 3 radially inwardly, i.e., forming the crimped portion 20.

Finally, the ground electrode 27 is bent to adjust the spark gap 33 between the front end face of the center electrode 5 and the ground electrode 27.

The spark plug 1 of the above structure can be manufactured in the series of these process steps.

Although the present invention has been described with reference to the above specific embodiments, the invention is not limited to these exemplary embodiments. Various modifications and variations of the embodiments described above will occur to those skilled in the art in light of the above teachings.

Figure 3:
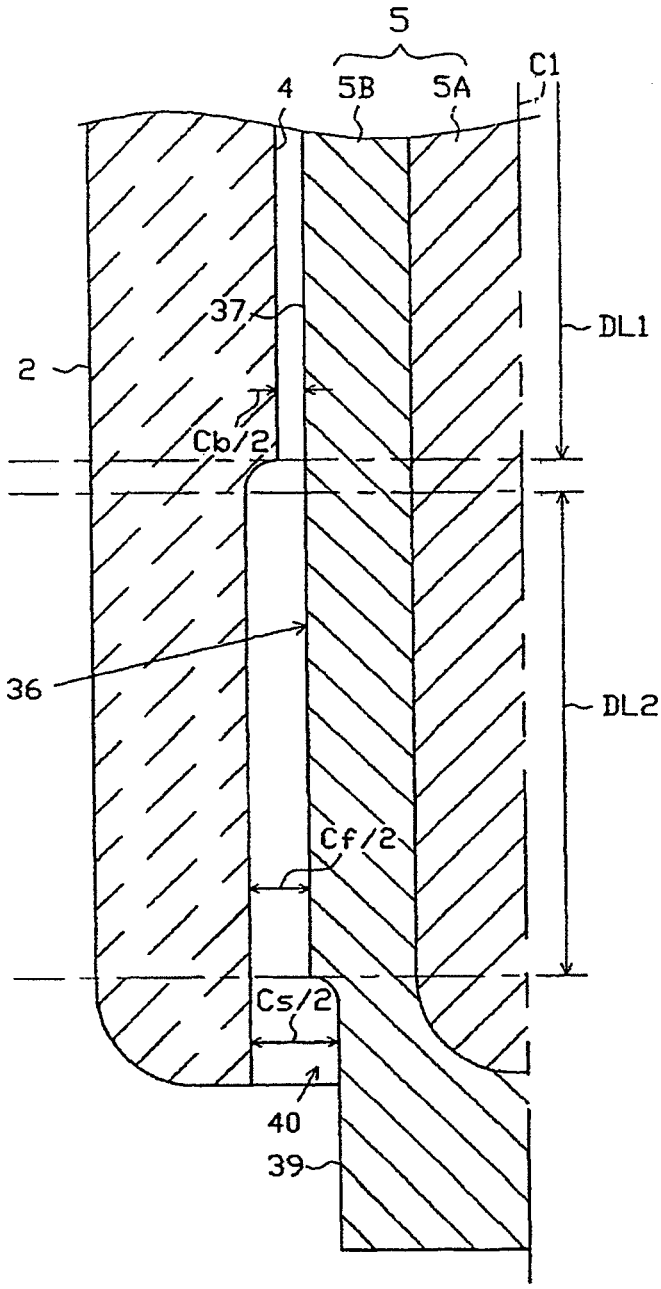
FIG. 3 is an enlarged section view of a front end portion of a spark plug according to another embodiment of the present invention.

In the above embodiment, the middle-diameter section 38 is formed smaller in diameter than the large-diameter section 37 so that the diameter difference Cf is set larger than the diameter difference Cb. Alternatively, the diameter difference Cf can be set larger than the diameter difference Cb by increasing the diameter of the axial hole 4 within the second constant diameter difference region DL2, without forming the middle-diameter section 38, as shown in FIG. 3.

Figure 4:
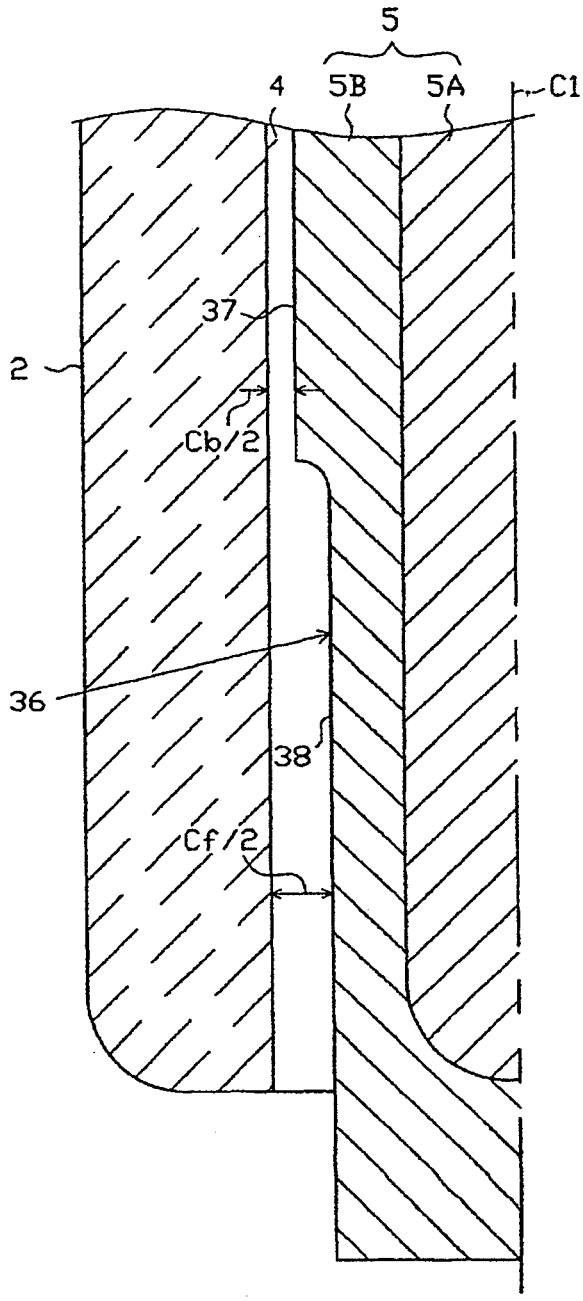
FIG. 4 is an enlarged section view of a front end portion of a spark plug according to another embodiment of the present invention.

As shown in FIG. 4, the small-diameter section 39 may not be provided although the small-diameter section 39 is provided on the front end of the cylindrical portion 36 in the above embodiment.

The spark plug may be configured to satisfy the following condition: Cc<Cf where Cc is a diameter difference between the inner diameter of the axial hole 4 and the outer diameter of the cylindrical portion 36 at an axial position C rearward of the axial position F. In the case where the small-diameter section 39 is formed at a position closer to the front end of the spark plug 1 than the second constant diameter difference region DL2 so as to extend over the front end face of the ceramic insulator 2 as in the above embodiment, the spark plug may be configured to satisfy the following conditions: Cc<Cf and Cc<Cs where Cs is a diameter difference between the inner diameter of the axial hole and the outer diameter of the cylindrical portion at an axial position C between the axial position F and an arbitrary axial position S on the small-diameter section 39. If carbon fouling deeply enters the clearance between the cylindrical portion 36 of the center electrode 5 and the axial hole 4 of the ceramic insulator 2, the ceramic insulator 2 can be broken even by slight thermal expansion of the center electrode 5. By satisfying the conditions: Cc<Cf and Cc<Cs, i.e., decreasing the size of the clearance between the ceramic insulator 2 and the cylindrical portion 36 at the axial position C located closer to the front end of the spark plug 1 than the axial position F and closer to the rear end of the spark plug 1 than the axial position S, it becomes possible to avoid the carbon fouling from deeply entering the clearance between the cylindrical portion 36 and the axial hole 4 and thereby prevent the breakage in the ceramic insulator 2 more effectively.

Figure 5A:
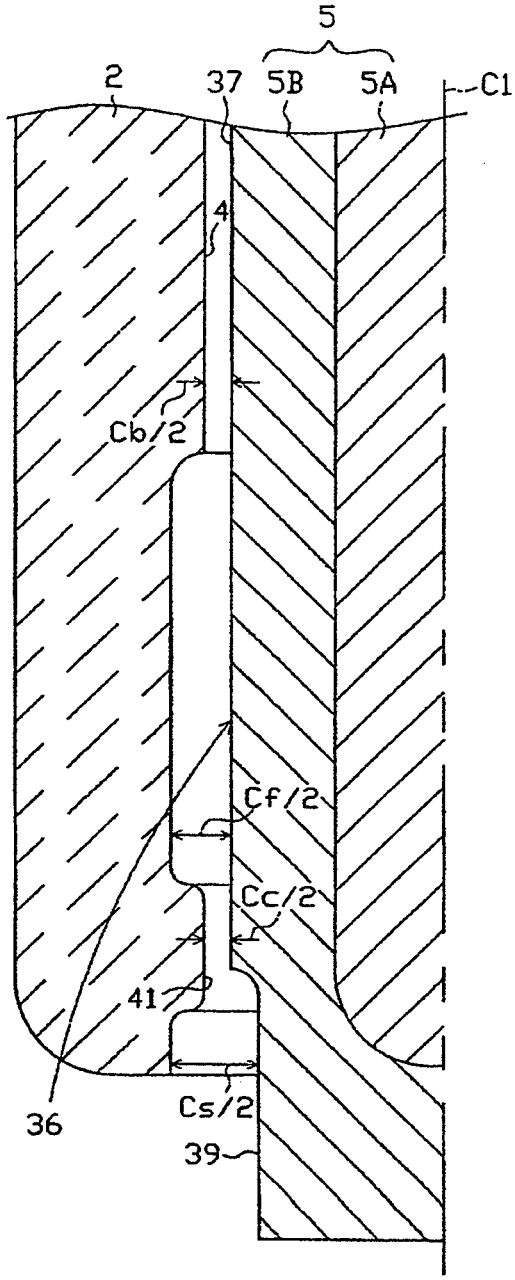
FIG. 5A is an enlarged section view of a front end portion of a spark plug according to another embodiment of the present invention.
Figure 5B:
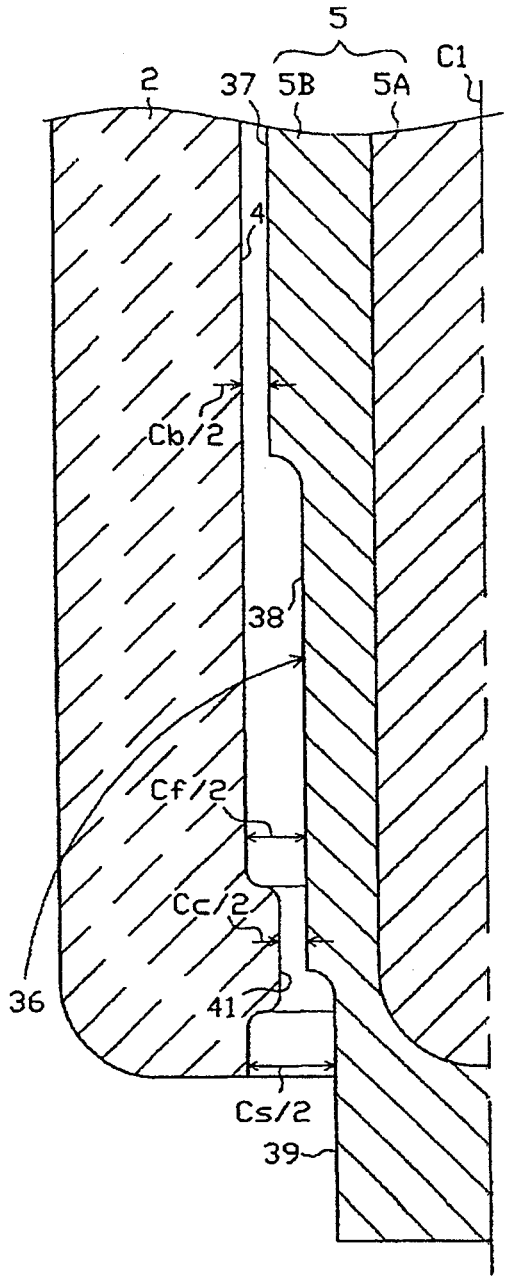
FIG. 5B is an enlarged section view of a front end portion of a spark plug according to another embodiment of the present invention.

For instance, an intermediate large-diameter section 41 can be formed in the axial hole 4 of the ceramic insulator 2 so as to protrude toward the position directly rear of the small-diameter section 39 in such a manner that the diameter difference Cc between the inner diameter of the axial hole 4 and the outer diameter of the cylindrical portion 36 at the position directly rear of the small-diameter section 39 becomes smaller than the diameter differences Cf and Cs as shown in FIGS. 5A and 5B. The formation of such an intermediate large-diameter section 41 makes it possible to prevent the carbon fouling from deeply entering the clearance between the cylindrical portion 36 and the axial hole 4.

Figure 6A:
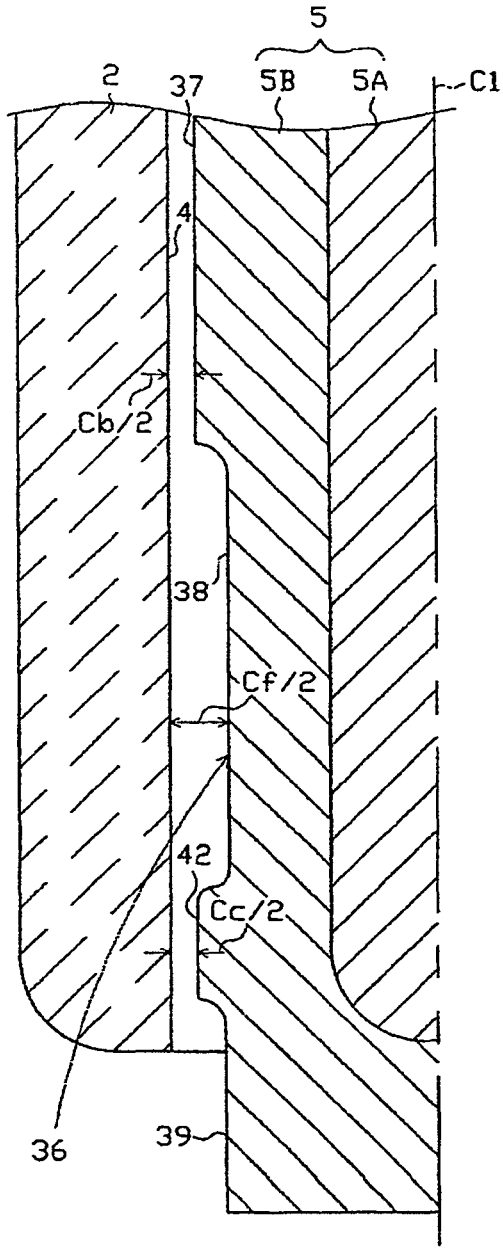
FIG. 6A is an enlarged section view of a front end portion of a spark plug according to another embodiment of the present invention.
Figure 6B:
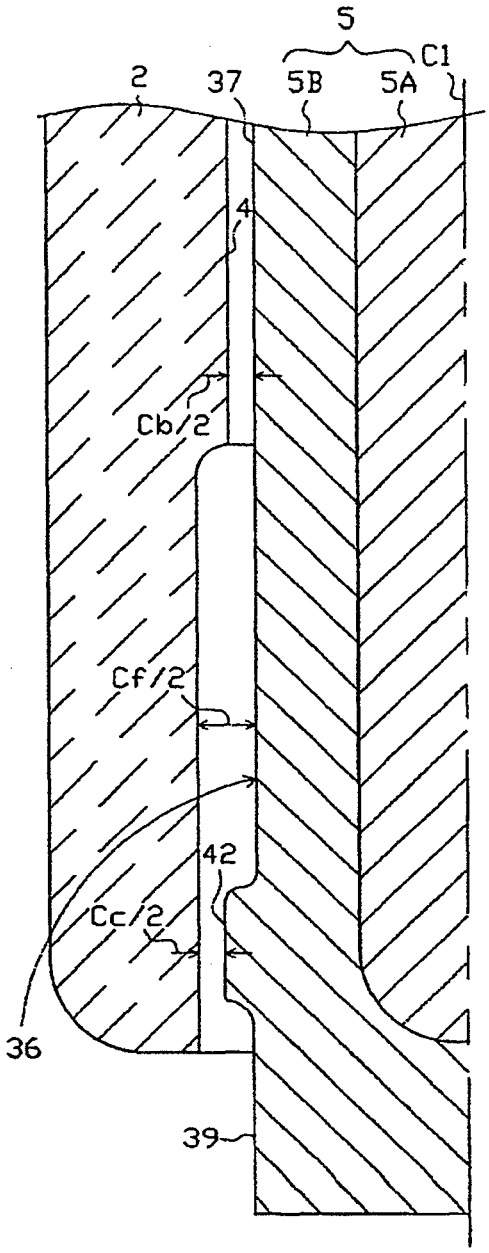
FIG. 6B is an enlarged section view of a front end portion of a spark plug according to another embodiment of the present invention.

An intermediate large-diameter section 42 can alternatively be formed at a position closer to the rear end of the spark plug 1 than the small-diameter section 39 so as to protrude radially outwardly in such a manner that the diameter difference Cc between the inner diameter of the axial hole 4 and the outer diameter of the cylindrical portion 36 at the position directly rear of the small-diameter section 39 becomes smaller than the diameter difference Cf as shown in FIGS. 6A and 6B. The formation of such an intermediate large-diameter section 42 produces the same effect as that of the intermediate large-diameter section 41 of FIGS. 5A and 5B. In FIG. 6A, the intermediate large-diameter section 42 is made larger in outer diameter than the middle-diameter section 38. For example, the outer diameter of the intermediate large-diameter section 42 is set to ϕ 2.59 mm that is the same as that of the large-diameter section 37. On the other hand, the intermediate large-diameter section 42 is made larger in outer diameter than the large-diameter section 37 in FIG. 6B. (For example, the outer diameter of the intermediate large-diameter section 42 is set to ϕ 2.61 mm.)

Figure 7A:
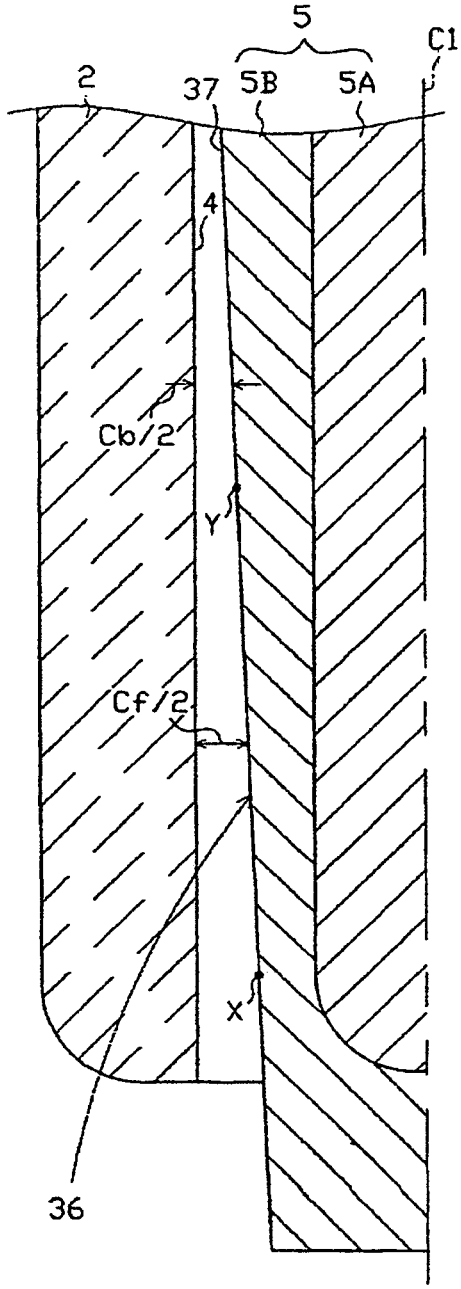
FIG. 7A is an enlarged section view of a front end portion of a spark plug according to another embodiment of the present invention.
Figure 7B:
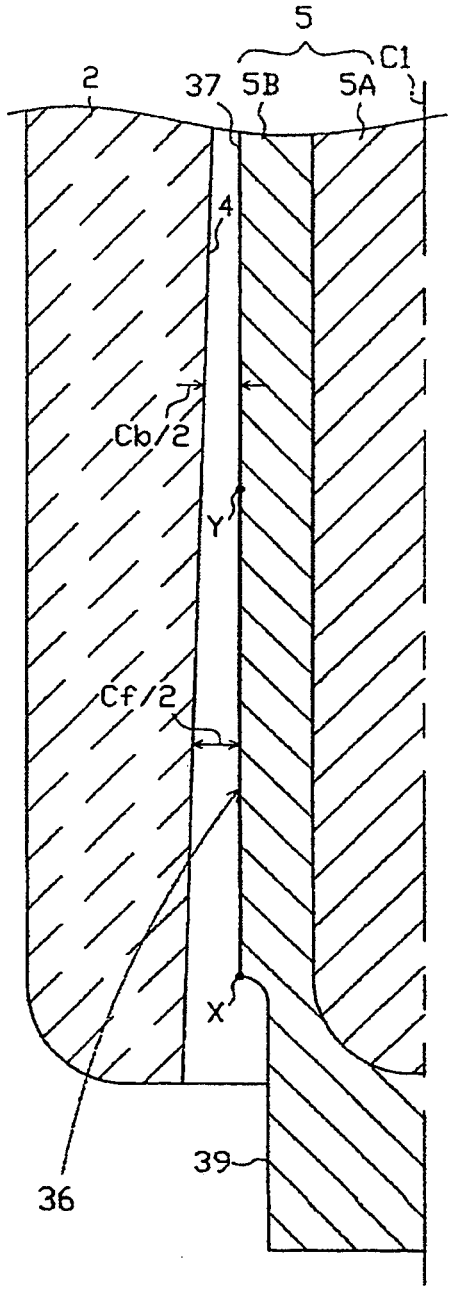
FIG. 7B is an enlarged section view of a front end portion of a spark plug according to another embodiment of the present invention.

In the above embodiment, the diameter difference Cf is set larger than the diameter difference Cb by forming the middle-diameter section 38 smaller in diameter than the large-diameter section 37. Alternatively, the cylindrical portion 36 may be tapered down toward the front in such a manner that the diameter difference Cf between the inner diameter of the axial hole 4 and the outer diameter of the cylindrical portion 36 at a given position between a position X 3 mm rear from the front end of the ceramic insulator 2 and a position Y a given distance (e.g. 4 mm to 10 mm) rear from the position X in the direction of the axis C1 becomes larger than the diameter difference Cb between the inner diameter of the axial hole 4 and the outer diameter of the cylindrical portion 36 at the rear of the aforementioned given position as shown in FIG. 7A. As shown in FIG. 7B, the diameter difference Cf may be set larger than the diameter difference Cb by tapering the axial hole 4 to increase the inner diameter of the axial hole 4 toward the front end.

Further, the cylindrical portion 36 of the center electrode 5 can preferably be held in the loose-fit state in a part of the ceramic insulator 2 corresponding to the leg portion 13 that is closer to the front end of the spark plug 1 than the shoulder portion 14, which is engaged with the metal shell 3 via the plate packing 22, so that the diameter difference Cb is equivalent to a difference between the outer diameter of the cylindrical portion 36 and the inner diameter of the part of the axial hole 4 corresponding to the leg portion 13. In order to prevent the breakage in the ceramic insulator 2 efficiently, it is important to define the diameter difference Cb in the axial region corresponding to the leg portion 13. In this configuration, the center electrode 5 is expected to attain sufficient thermal radiation. It becomes thus possible to obtain further improvement in thermal radiation characteristics without a fear of the breakage in the ceramic insulator 2 even if the cylindrical portion 36 of the center electrode 5 is in contact with the axial hole 4 of the ceramic insulator 2.

Figure 8A:
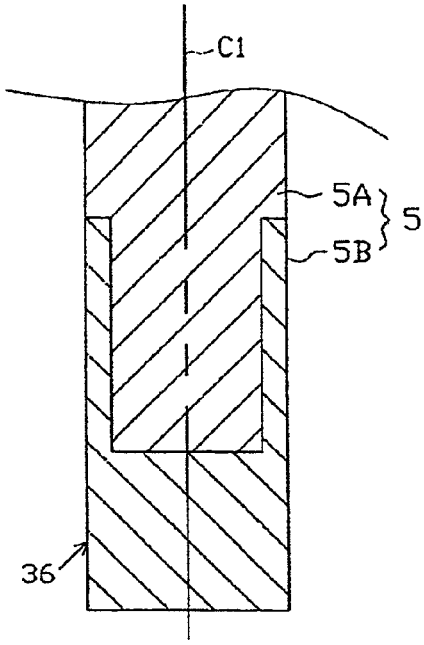
FIG. 8A is an enlarged section view of a front end portion of a spark plug according to another embodiment of the present invention.
Figure 8B:
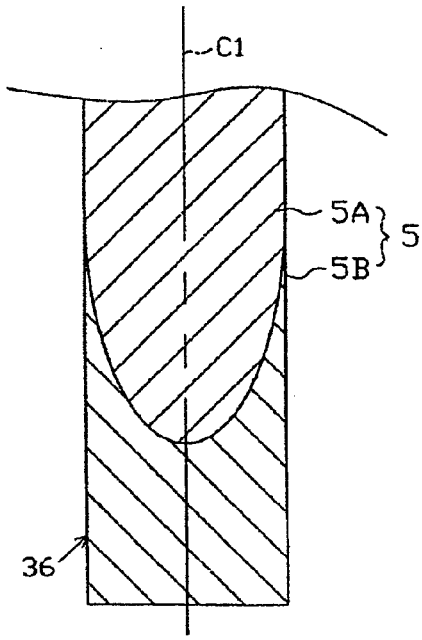
FIG. 8B is an enlarged section view of a front end portion of a spark plug according to another embodiment of the present invention.

In the above embodiment, the center electrode 5 is formed by covering the inner layer 5A of relatively high thermal expansion coefficient material with the outer layer 5B of nickel alloy. Alternatively, the outer layer 5B can be formed only on the front end portion of the center electrode 5 so that the inner layer 5A gets exposed through the surface of the rear end portion of the center electrode 5 on which the outer layer 5B does not exist as shown in FIGS. 8A and 8B. Further, iron-based alloy in which iron is added with chromium or aluminum may alternatively be used as the metal material of the outer layer 5B in place of the nickel alloy.

It is conceivable to provide a cement material (cement band) in a space between a part of the center electrode 5 from the front end of the flanged portion 35 to the rear end of the cylindrical portion 36 and the axial hole 4. This enables smooth heat transfer from the center electrode 5 to the ceramic insulator 2 for further enhancement of thermal radiation of the center electrode 5.

The outer diameter of the front end portion of the ceramic insulator 2 can be further reduced for enhancement of thermal radiation of the ceramic insulator 2.

Although the spark gap 33 is defined between the front end face of the center electrode 5 and the ground electrode 27 in the above embodiment, a known noble metal tip of platinum or iridium may be joined to the front end face of the center electrode 5 to define the spark gap 33 between the noble metal tip and the ground electrode 27. A noble metal tip may be joined to a surface portion of the ground electrode 27 facing the center electrode 5 to define the spark gap 33 between the noble metal tip joined on the ground electrode 27 and the front end face of the ground electrode 5 or the noble metal tip joined on the ground electrode 5.

In the above embodiment, the ground electrode 27 is joined to the front end of the metal shell 3. The ground electrode may alternatively be formed by cutting a part of the metal shell (or welding a front end fitting to the metal shell and then cutting a part of the fitting). (See Japanese Laid-Open Patent Publication No. 2006-236906.) Further, the ground electrode may be designed as a so-called creeping discharge electrode so as to face the outer peripheral surface of the center electrode and the front end portion of the insulator.

Although the tool engagement portion 19 is hexagonal in cross section in the above embodiment, the shape of the tool engagement portion 19 is not limited thereto. The tool engagement portion 19 may alternatively have a Bi-HEX (modified 12-point) shape (according to ISO22977: 2005(E)) etc.

The invention claimed is:

1. A spark plug for an internal combustion engine, comprising:

a center electrode extending in the direction of an axis of the spark plug and having a core of higher thermal expansion coefficient than that of a front end thereof, the center electrode including a flanged portion radially outwardly protruding on a rear side thereof and a cylindrical portion located closer to a front end of the spark plug than the flanged portion and being smaller in diameter than the flanged portion;

an insulator having an axial hole formed in the direction of the axis to retain the flanged portion in the axial hole with the cylindrical portion held in a loose-fit state in the axial hole; and a metal shell accommodating the insulator, wherein the spark plug satisfies the following condition: $Cb<Cf$ where Cb is a diameter difference between an inner diameter of the axial hole and an outer diameter of the cylindrical portion at an arbitrary axial position B in the direction of the axis; and Cf is a diameter difference between the inner diameter of the axial hole and the outer diameter of the cylindrical portion at an axial position F located closer to the front end of the spark plug than the axial position B in the direction of the axis, wherein the axial position B and the axial position F are located inside the axial hole of the insulator, wherein a difference between the inner diameter of the axial hole and the outer diameter of the cylindrical portion at position B is less than or equal to 0.09 mm to allow thermal radiation from the center electrode to the insulator.

2. The spark plug for the internal combustion engine according to claim 1, wherein there is a plurality of regions of substantially constant diameter difference between the inner diameter of the axial hole and the outer diameter of the cylindrical portion, including a first constant diameter difference region that is the longest in the direction of the axis; wherein the axial position B is located in the first constant diameter difference region; and wherein the axial position F is located closer to the front end of the spark plug than the first constant diameter difference region.

3. The spark plug for the internal combustion engine according to claim 1, wherein the spark plug satisfies the following condition: $0<Cf-Cb\leq 0.06$.

4. The spark plug for the internal combustion engine according to claim 1, wherein each of the axial positions B and F is located on the cylindrical portion at least 3 mm rear from a front end face of the insulator in the direction of the axis.

5. The spark plug for the internal combustion engine according to claim 1, wherein the spark plug satisfies the following condition: $Cc<Cf$ where Cc is a diameter difference between the inner diameter of the axial hole and the outer diameter of the cylindrical portion at an axial position C located closer to the front end of the spark plug than the axial position F in the direction of the axis.

6. The spark plug for the internal combustion engine according to claim 2, wherein the regions of substantially constant diameter difference between the inner diameter of the axial hole and the outer diameter of the cylindrical portion includes a second constant diameter difference region that is the second longest in the direction of the axis and is closer to the front end of the spark plug than the first constant diameter difference region; wherein the axial position F is located in the second constant diameter difference region; and the cylindrical portion includes a small-diameter section located closer to the front end of the spark plug than the second constant diameter difference region and formed smaller in diameter than a rear side thereof so as to extend over a front end face of the insulator.

7. The spark plug for the internal combustion engine according to claim 6, wherein the spark plug satisfies the following conditions: $Cc<Cf$ and $Cc<Cs$ where Cs is a diameter difference between the inner diameter of the axial hole and the outer diameter of the small-diameter section; and Cc is a diameter difference between the inner diameter of the axial hole and the outer diameter of the cylindrical portion at an axial position C between the axial position F and an arbitrary axial position S on the small-diameter section.

8. The spark plug for the internal combustion engine according to claim 1, wherein the insulator has a stepped portion engaged with the metal shell via a plate packing and a leg portion located closer to the front end of the spark plug than the stepped portion; wherein the cylindrical portion is held in the loose-fit state in the leg portion of the insulator; and wherein the diameter difference Cb is a diameter difference between the outer diameter of the cylindrical portion and the inner diameter of part of the axial hole corresponding to the leg portion.

9. The spark plug for the internal combustion engine according to claim 1, wherein the cylindrical portion of the center electrode includes a large-diameter section, a middle-diameter section located closer to the front end of the spark plug than the large-diameter section and having a smaller outer diameter than that of the large-diameter section and a small-diameter section located closer to the front end of the spark plug than the middle-diameter section and having a smaller outer diameter than that of the middle-diameter section;

wherein the insulator includes a stepped portion formed on an inner peripheral surface of the axial hole and engaged with the flanged portion and a front end portion formed with a constant inner diameter to be closer to the front end of the spark plug than the stepped portion and accommodating therein the large-diameter section and the middle-diameter section; wherein the axial position B is located within the large-diameter section; and wherein the axial position F is located within the middle-diameter section.

10. The spark plug for the internal combustion engine according to claim 9, wherein the large-diameter section is longer in length in the direction of the axis than the middle-diameter section.

11. The spark plug for the internal combustion engine according to claim 9, wherein the middle-diameter section is longer in length in the direction of the axis than the small-diameter section.

12. The spark plug for the internal combustion engine according to claim 9, wherein a difference between the outer diameter of the large-diameter section and the outer diameter of the middle-diameter section is smaller than a difference between the outer diameter of the middle-diameter section and the outer diameter of the small-diameter section.

13. The spark plug for the internal combustion engine according to claim 9, wherein the cylindrical portion further includes an intermediate large-diameter section located between the small-diameter section and the middle-diameter section and having a larger outer diameter than that of the middle-diameter section.

14. The spark plug for the internal combustion engine according to claim 1 wherein the metal shell accommodates the insulator at least at the axial position F.

15. The spark plug for the internal combustion engine according to claim 1 wherein the center electrode has an outer layer and an inner layer, and wherein the inner layer is made of a material having a higher thermal conductivity and a higher thermal expansion coefficient than a material of the outer layer.

* * * * *